United States Patent [19]

Litwak et al.

[11] Patent Number: 4,552,306

[45] Date of Patent: Nov. 12, 1985

[54] DRINKING FOUNTAIN DEVICE AND COMBINATION SINK AND DRINKING FOUNTAIN DEVICE

[76] Inventors: Alfred A. Litwak, Box 40, R.D. 1, Frenchtown, N.J. 08825; Laurene H. O'Donnell, R.D. 1, Box 333AA, Milford, N.J. 08848

[21] Appl. No.: 436,848

[22] Filed: Oct. 26, 1982

[51] Int. Cl.[4] ..... E03B 9/20

[52] U.S. Cl. ..... 239/29; 239/24

[58] Field of Search ..... 239/24–30; 251/319, 320, 321, 322, 323; 4/119, 191, 203, 204, 207, 567, 568, 615, 619, 623, 624, 626, 654, 661

[56] References Cited

U.S. PATENT DOCUMENTS

| | | | |
|---|---|---|---|
| 1,207,661 | 12/1916 | Taylor | 239/29 |
| 1,763,808 | 6/1930 | Muffly | 239/29 X |
| 1,900,591 | 3/1933 | Taylor | 4/191 |
| 2,572,463 | 10/1951 | Fine | 4/196 |
| 2,579,769 | 12/1951 | Tyler | 239/25 |
| 2,628,062 | 2/1953 | Weber | 251/322 |
| 3,101,174 | 8/1963 | Loveland | 239/27 |
| 3,272,181 | 9/1966 | Ramsey | 251/321 |
| 3,473,173 | 10/1969 | Macivlaitis | 4/626 |
| 3,554,446 | 1/1971 | Castillo et al. | 239/24 |
| 3,579,656 | 5/1971 | Guarrasi | 4/626 |
| 3,921,903 | 11/1975 | Grimes et al. | 239/29 |
| 4,389,016 | 6/1983 | Gibbs | 239/24 |

FOREIGN PATENT DOCUMENTS

| | | | |
|---|---|---|---|
| 550138 | 2/1923 | France | 251/322 |
| 477770 | 5/1951 | Italy | 251/323 |

*Primary Examiner*—Jeffrey V. Nase

[57] ABSTRACT

The present invention is directed to a drinking fountain device for substantially horizontal mounting, especially for mounting in a countertop adjacent to a sink. It is also directed to the combination of a sink and the mentioned drinking fountain device. In particular, the drinking fountain device is mounted substantially flush to the surface so that its working parts are mostly below the horizontal surface of mounting. This eliminates the possibility of the drinking fountain becoming an obstruction. The fountain itself operates by a push button mechanism. Optionally, a faceplate may be fitted onto one embodiment of the fountain device of the present invention so as to channel runoff into a sink. Alternatively, the bracket of the drinking fountain device of the present invention may be fashioned so as to have a top surface built-in faceplate.

3 Claims, 12 Drawing Figures

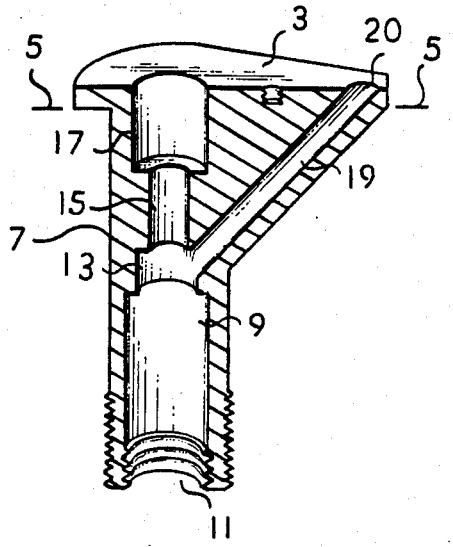
FIG. 1
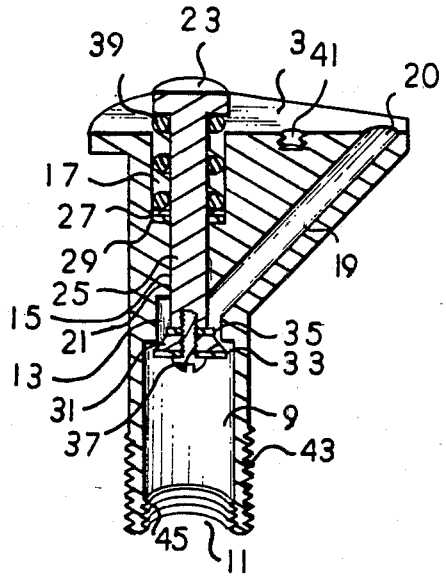
FIG. 2
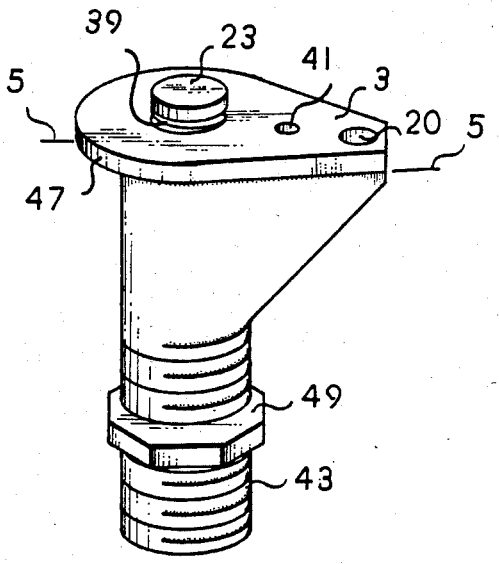
FIG. 3
FIG. 4
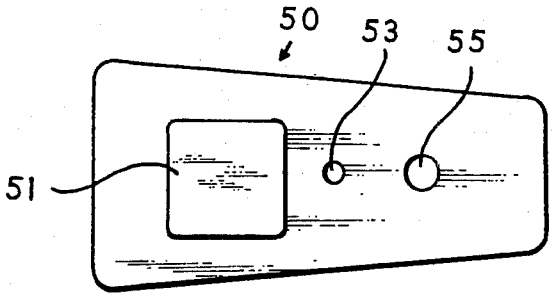

DRINKING FOUNTAIN DEVICE AND COMBINATION SINK AND DRINKING FOUNTAIN DEVICE

BACKGROUND OF THE INVENTION

1. Field of the Invention

This invention relates to a drinking fountain device which is mountable in a substantially horizontal plane, as well as to a combination sink and drinking fountain device. It is particularly directed to such devices and combinations as may be installed in conventional countertops such as Formica ® or wood or plastic countertops, for example.

2. Prior Art Statement

U.S. Pat. No. 2,841,799 teaches a combination article consisting of a sink capable of being installed in horizontal surfaces, such as countertops, a gooseneck faucet and a sidemounted bubbler-type drinking fountain. While this patent illustrates a faucet in conjunction with a drinking fountain, the drinking fountain is one of conventional construction having a standard control valve and an apertured ball outlet with guard. It is unfortunate for the user, however, in that the drinking fountain is above the horizontal surface of the sink. The possibility of bumping it or catching it onto a shirtsleeve is considerable. Also, working on the countertop with items that are to be washed would be awkward due to the necessity of having to lift such items up and over the drinking fountain, e.g., slicing and washing vegetables. Thus, while this patent teaches the sink and drinking fountain combination shown, it fails to recognize or to solve some of the problems mentioned above which are overcome by the present invention.

U.S. Pat. No. 2,865,182 illustrates a conventional bubbler-type drinking fountain. The valve and nozzle are of conventional design.

U.S. Pat. No. 3,133,701 teaches a combination faucet and drinking fountain. The combined features inherently require "above sink" location and could not be considered as directed toward the present invention. In fact, the patent creates problems for the faucet-fountain because typically a fountain should be at a location close to where one can bend over and drink from, whereas a faucet should usually be set to the back of a sink to allow large pots, etc., to be placed thereunder. By combining a faucet and a drinking fountain in the same location and outlet, neither can be optimally situated without adversely affecting the other. In any event, it appears that this patent teaches away from, rather than toward the present invention.

U.S. Pat. No. 3,799,439 teaches a recessed bubbler-type drinking fountain which includes a vertically mounted outlet housed in a chamber. The drinking fountain outlet is recessed within an opening to prevent children from squirting or misdirecting the water jet and to prevent vandalism. It would not function, however, in a horizontal plane as the recess would result in a standing pool of water which itself would prevent proper flow upon subsequent usage. On the other hand, the present invention drinking fountain device prevents the collection of water, is not recessed, and is directed to clearance of countertops and not avoidance of spraying or vandalism. Thus, U.S. Pat. No. 3,799,439 addresses a problem different from that of the present invention and solves that problem in a different manner.

SUMMARY OF THE INVENTION

The present invention is directed to a drinking fountain device for substantially horizontal mounting, especially for mounting in a countertop adjacent to a sink. It is also directed to the combination of a sink and the mentioned drinking fountain device. In particular, the drinking fountain device is mounted substantially flush to the surface so that its working parts are mostly below the horizontal surface of mounting. This eliminates the possibility of the drinking fountain becoming an obstruction. The fountain itself operates by a push button mechanism. Optionally, a faceplate may be fitted onto one embodiment of the fountain device of the present invention so as to channel runoff into a sink. Alternatively, the bracket of the drinking fountain device of the present invention may be fashioned so as to have a top surface built-in faceplate.

Thus it is an object of the present invention to provide for a drinking fountain device which may be mounted into a conventional countertop adjacent to a sink and which may be connected to conventional domestic, commercial and industrial "sink faucet pressure" water lines.

It is another object of the present invention to provide for such a drinking fountain device which is of low profile construction and therefore will not be obstructive during other utilization of the countertop and/or sink.

It is yet another object of the present invention to provide a combination drinking fountain device and sink which may be constructed as an integral unit and installed as a single unit in new homes, offices, laboratories, lavatories, etc.

Another object of the present invention is to provide a drinking fountain device which is accessible and convenient for domestic, commercial and industrial uses, yet is relatively inexpensive in cost.

These and other objects of the present invention will become apparent with reference to the foregoing and the following disclosure, the drawings and the claims.

BRIEF DESCRIPTION OF THE DRAWINGS

The present invention is illustrated by the drawings presented herein, in which, briefly:

FIG. 1 illustrates a cut view of a bracket and faucet means housing for one embodiment of the present invention;

FIG. 2 shows a cut view of the full drinking fountain device of FIG. 1, including all moving components;

FIG. 3 shows an uncut perspective view of the drinking fountain device of FIG. 2;

FIGS. 4,5, and 6 show a top view, a frontal view and a side view, respectively, of a faceplate which may be utilized with the device of FIG. 3;

DETAILED DESCRIPTION OF THE INVENTION AND THE DRAWINGS

Figure 5:
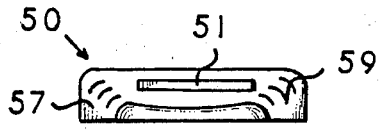

Now, referring in particular detail to the drawings of this invention, FIG. 1 generally shows a cut view of a bracket and faucet means housing of a drinking fountain device embodiment of the present invention.

The bracket 3 has a top portion with a horizontal baseline at 5 and, as shown, is capable of being mounted in a substantially horizontal plane, e.g., by being fitted into a hole and screwed in. This baseline 5 may be coincidental with the top surface of bracket 3, slightly above it or slightly below it, depending upon the particular arrangement used for affixing the drinking fountain device to a countertop. Faucet means 7 of the present invention includes a housing, operable faucet parts contained therein, an inlet and an outlet. FIG. 1 illustrates faucet means shown generally as 7 having housing 9 with inlet 11 and outlet 13. The operable faucet parts are shown in FIG. 2 below. Inlet 11 is shown to be threaded and may be fitted with threaded brass or other conventional plumbing fixtures. The present invention also includes a push button mechanism which is housed within conduit 15 and recess 17 and is also shown in FIG. 2, discussed below. Fountain conduit 19 is connected to outlet 13 and projects generally upwardly, as shown. It may optionally be, and in this embodiment is, truncated at 20 in a substantially horizontal plane. Note that this embodiment shows the bracket 3, the housing 9, and the conduit 19 all as a single integral unit. Alternatively, these components could be separately constructed and then assembled together.

FIG. 2 illustrates the device of FIG. 1 wherein like components are like numbered, except that FIG. 2 shows, in addition, all of the working parts of this particular embodiment of the present invention. Thus, push button mechanism 21 is shown with button 23 and plunger stem 25 connected to the faucet means operating parts, which, in this embodiment, include metal washer 27, rubber washer 29, faucet washer 31, metal washers 33 and 35, and screw 37. Spring 39 maintains tension on push button mechanism 21 and maintains the faucet means in the closed portion, except when button 23 is depressed. When the user presses button 23, the faucet washer 31, in conjunction with the other moving parts which are attached to plunger stem 25, moves down into housing 9, whereby water flows around same, and flows through outlet 13 and conduit 19 to yield a fountain flow upwardly for drinking or other purpose. Conduit 19 is constructed with a thin enough cross-section so as to maintain enough pressure to yield a fountain of the desired size. For example, with conventional city and household well water pressures, conduit 19 may have a cross-section of about $\frac{3}{8}$ inch diameter to $\frac{1}{4}$ inch diameter, more or less. Also shown in FIG. 2 are external threading 43 and internal threading 45. The optional external threading 43 is adapted to receive a fastening nut, described in conjunction with FIG. 3, below, and internal threading 45 is adapted to receive a conventional threaded plumbing connection.

FIG. 3 shows the embodiment of FIGS. 1 and 2 in an uncut perspective view. Again, like components are like numbered where shown. The present invention device, shown generally as 1, may be installed in any substantially horizontal surface near a sink, drain or basin. For example, it may be mounted in a kitchen countertop adjacent to a counter sink, as follows:

An oval hole may be cut into a countertop adjacent to a set in sink. The cross-section of the cut should be greater than the cross-section of device 1 as measured below baseline 5 and should be less than the cross-section of the top surface of bracket 3, i.e., above baseline 5. The device 1 is placed in the oval hole such that the conduit 19 faces and is projected toward the sink basin. Flange 47 of bracket 3 rests atop and covers the oval hole while the portion of device 1 below baseline 5 rests within the oval hole. Locknut 49 is then tightened, on threading 43, against the underside of the oval hole to securely fasten device 1 to the countertop. (Other conventional means for fastening device 1 should now be apparent and may alternately be utilized.) Conventional cold water plumbing is attached to inlet 11 as described above.

Figure 6:
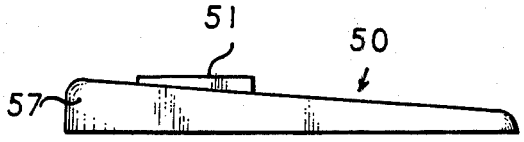

FIGS. 4, 5, and 6 show top, frontal and side views, respectively, of a faceplate which may be used with the device of FIG. 3. The faceplate, shown generally as 50, includes rectangular button cover 51, screw hole 53 and water stream orifice 55. As shown in FIGS. 5 and 6, the faceplate is tapered inwardly and downwardly toward the orifice end (toward the sink) for proper runoff.

Figure 7:
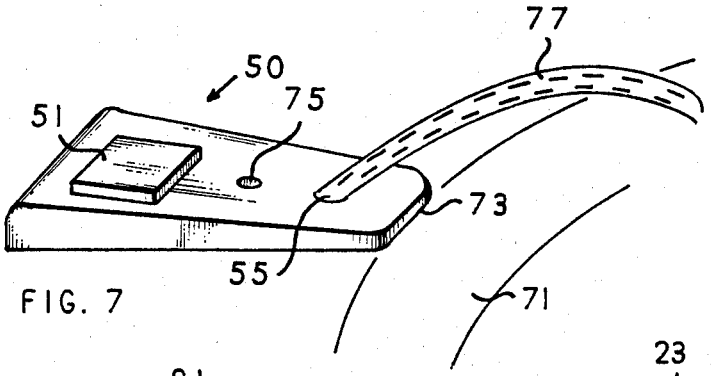
FIG. 7 shows a partial view of the device of FIG. 3 and the faceplate of FIGS. 4, 5, and 6 installed and operating.

FIG. 7 shows a partial view of the device 1 and faceplate 50 located adjacent sink 71, installed and operating. Faceplate 50 is affixed to device 1 by rectangular button cover 51 being fitted over button 23 (see FIG. 3), by orifice 55 being fitted over opening 20 (see FIG. 3) and by screw 75 being securely fastened through screw hole 53 into threaded opening 41 of bracket 3 (see FIG. 3). Preferably, rectangular button cover 51 fits snugly over button 23, and sides 57 and 59 fit snugly over the width of the top of bracket 3 at its widest width. As shown, faceplate 50, and device 1 (not shown), are immediately adjacent to the side edge 73 of sink 71 and, when cover 51 is depressed, water stream 77 flows outwardly in a controlled and directed fashion into sink 71 for drinking or other purpose.

Figure 8:
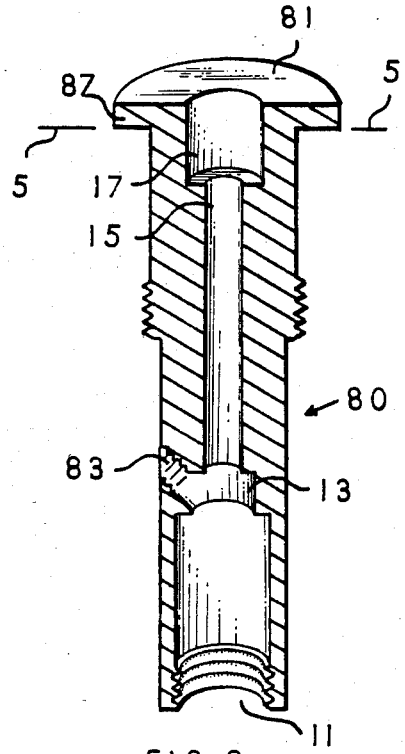
FIG. 8 illustrates a cut view of a bracket and faucet means housing of another embodiment of the present invention.
Figure 9:
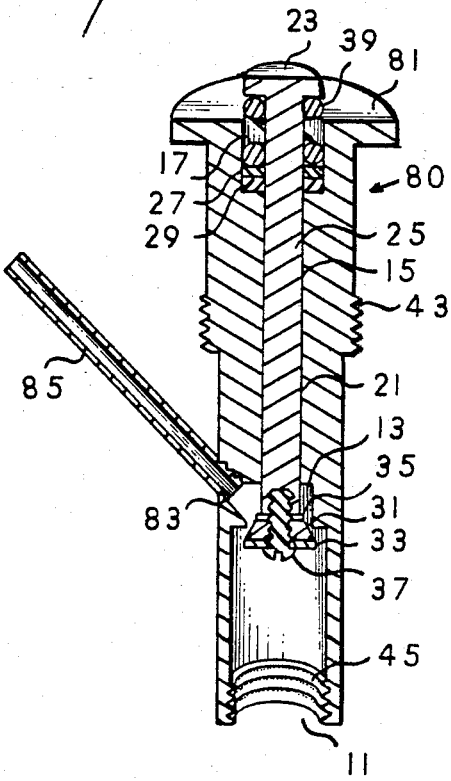
FIG. 9 illustrates a cut view of the full drinking fountain device of FIG. 8, including all moving components.
Figure 10:
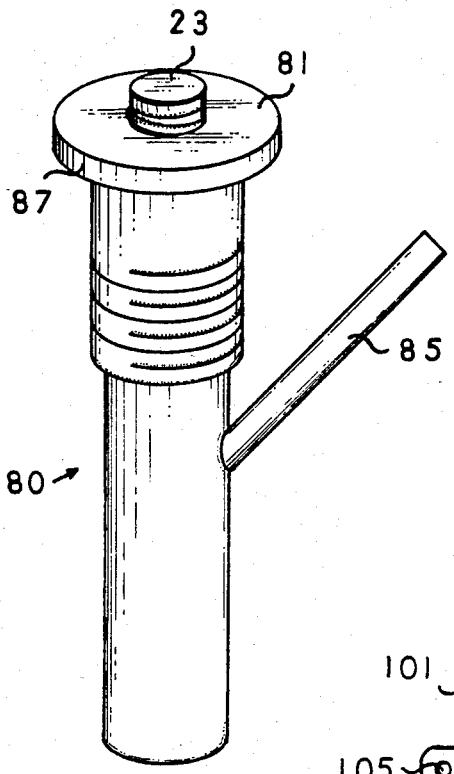
FIG. 10 shows an uncut perspective view of the device of FIG. 9.

FIGS. 8, 9, and 10 illustrate cut views without and with operating components and conduit and an uncut perspective view of another embodiment of the device of the present invention, respectively. Parts which are identical to those of the device shown in FIGS. 1, 2, and 3 are identically numbered. In this embodiment, device 80 has bracket 81 with a substantially circular top surface, as shown. Also, the conduit for the outward flow of water from outlet 13 is not an integral portion of a single part but instead is affixed to the housing via threading 83, and is shown in FIGS. 9 and 10 as conduit 85. Conduit 85 is preferably, but not required to be, truncated in the horizontal plane, depending, for example, on the particular faceplate which may be used in conjunction therewith.

This alternative device to the device of FIGS. 1, 2, and 3 is shown to illustrate a more easily and less expensive embodiment of the present invention. Other alternatives should now be apparent to the artisan without exceeding the scope of the present invention.

As mentioned above, the present invention is directed to a drinking fountain device and to a combination of a sink and drinking fountain device. Thus, while FIGS. 1 through 10 above are discussed in the context of a drinking fountain device of the present invention, the text relating thereto is also applicable to the combination sink and drinking fountain device of the present invention. For example, the device of FIGS. 1 through 3 or of FIGS. 8 through 10 may be incorporated into a sink and the combinations resulting constitute embodiments of the present invention.

Figure 11:
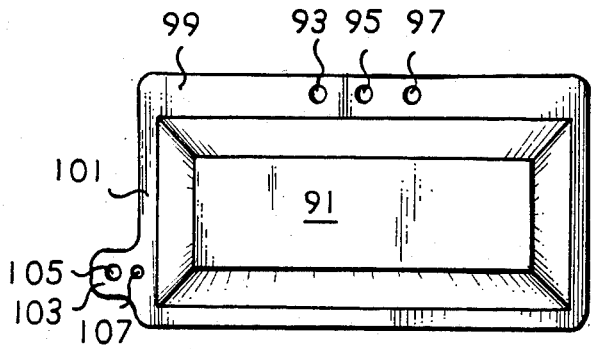
FIG. 11 shows a top view of a sink basin adapted to receive a drinking fountain device of the present invention at a side location; and, FIG. 12 shows a perspective partial view of a sink basin adapted to receive a drinking fountain device of the present invention at a corner location.

FIG. 11 illustrates a top view of a sink basin, e.g., of the stainless steel type, which may be employed as a component of the present invention. Basin 91 contains cutouts 93, 95, and 97 of conventional design to receive, for example, hot water faucet handle, outlet and cold water faucet handle, respectively. These cutouts 93, 95, and 97 are located at the back portion 99 of basin 91, in the usual manner. Left side 101 of basin 91 contains a flared portion 103 which includes cutouts 105 and 107. These cutouts 105 and 107 are dimensioned so as to receive the device 80 FIG. 10, such that the main housing of device 80 fits into cutout 105 and flange 87 (see FIG. 10) thereof rests atop flared portion 103, and such that conduit 85 coincides with cutout 107, and having conduit 85 appropriately truncated, as may be required. In the alternative, flared portion 103 could readily have a single oval hole adapted to receive the device of FIG. 3. In addition, flared portion 103 may be advantageously tapered inwardly and downwardly toward basin 91's center for water runoff. An optional faceplate may be employed, in the alternative.

Figure 12:
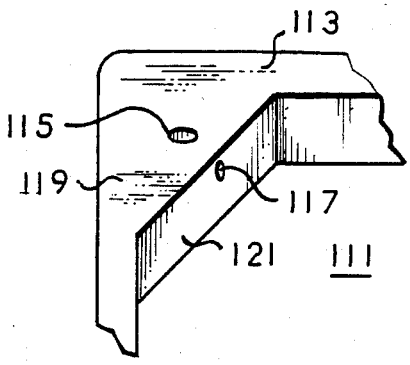

FIG. 12 shows a cut perspective view of a sink basin 111 with one corner 113 of the basin 111 molded so as to receive the drinking fountain device of the present invention. The device is installed, and only button 115 and conduit opening 117 are visible to the user. The button 115 is advantageously located on the top portion 119 of corner 113 whereas conduit opening 117 is located on the sidewall 121 of basin 111. The button 115 is depressed by the user and a controlled, directed stream of water is emitted from conduit opening 117.

While the present invention is described in detail with respect to the drawings and the foregoing disclosure, it should now be recognized that many variations and modifications may be made thereto within the purview of the artisan and without exceeding the scope of the present invention. Thus, the drawings and foregoing discussion are presented for illustrative purposes, and the present invention should not be construed to be limited thereto.

What is claimed is:

1. A single-stream drinking fountain device for substantially horizontal mounting, said device comprising a bracket having a substantially planar top surface and a bottom surface spaced apart from (each other) said top surface, said bottom surface forming a substantially horizontal plane at said baseline, said bracket having an orifice in said top surface, a housing (connected to said bottom surface of said bracket and) extending downward (therefrom) from said bottom surface, said housing containing (faucet) valve means located essentially below said baseline, said (faucet) valve means having an inlet and an outlet, said inlet being connectable to a source of water, said water retarded from passing through said inlet to said outlet by an off-on mechanism located at said top surface of said bracket and being substantially flush with said top surface and having a linkage through said housing to said (faucet) valve means, said off-on mechanism and said orifice both located in the same planar portion of said top surface, and a single conduit connected between said outlet of said (faucet) valve means and said top surface orifice, said conduit projecting upwardly from said (faucet) valve means to connect said (faucet) valve means with said orifice so that water passing through said (faucet) valve means also passes through said top surface orifice in a generally upwardly moving direction.

2. The invention set forth in claim 1 wherein said top surface of said bracket slopes toward said bottom surface of said bracket forming a forward portion of said bracket thinner than a rear portion of said bracket, and wherein said off-on mechanism is positioned on said bracket rearward of the position of said orifice on said bracket.

3. The invention set forth in claim 1 further comprising a sink having a flange along at least one side and wherein said bracket of said device is formed by said flange.

* * * * *